US007513123B2

(12) United States Patent
Lee et al.

(10) Patent No.: US 7,513,123 B2
(45) Date of Patent: Apr. 7, 2009

(54) UNITARY AIR CONDITIONER AND METHOD OF CONTROLLING VARIABLE OPERATION THEREOF

(75) Inventors: Won Hee Lee, Seoul (KR); Seung Youp Hyun, Seoul (KR); Jeong Taek Park, Ansan-si (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 292 days.

(21) Appl. No.: 11/317,015

(22) Filed: Dec. 27, 2005

(65) Prior Publication Data

US 2006/0156749 A1 Jul. 20, 2006

(30) Foreign Application Priority Data

Dec. 28, 2004 (KR) ..... 10-2004-0113679

(51) Int. Cl.
*G05D 23/12* (2006.01)
*F25B 49/00* (2006.01)

(52) U.S. Cl. ..... 62/157; 62/228.5; 62/231

(58) Field of Classification Search ..... 62/115, 62/157, 228.5, 231
See application file for complete search history.

(56) References Cited

U.S. PATENT DOCUMENTS 4,831,313 A * 5/1989 Beilfuss ..... 388/822
5,410,230 A 4/1995 Bessler et al.
5,592,058 A 1/1997 Archer et al.
5,592,059 A 1/1997 Archer et al.
5,628,199 A 5/1997 Hoglund et al.
5,673,568 A * 10/1997 Isshiki ..... 62/228.4
6,134,901 A 10/2000 Harvest et al.
2004/0016254 A1* 1/2004 Park ..... 62/229
2004/0093881 A1* 5/2004 Kim ..... 62/228.5
2004/0244389 A1* 12/2004 Denvir ..... 62/156
2005/0016192 A1* 1/2005 Park ..... 62/209

OTHER PUBLICATIONS

U.S. Appl. No. 11/316,472 to Lee et al., filed Dec. 29, 2005.
U.S. Appl. No. 11/316,985 to Lee et al., filed Dec. 27, 2005.

* cited by examiner

*Primary Examiner*—Marc E Norman
(74) *Attorney, Agent, or Firm*—Greenblum & Bernstein, P.L.C.

(57) ABSTRACT

A unitary air conditioner comprises a 1-stage thermostat mounted in a room for generating an air conditioner ON/OFF signal, an indoor unit configured to operate based on a signal from the 1-stage thermostat, and a variable-capacity outdoor unit connected to the 1-stage thermostat and the indoor unit. The variable-capacity outdoor unit has variable operation stages, which are changed based on the previous operation state and the current operation state. When a unitary-capacity operation signal is inputted from the 1-stage thermostat, a start operation stage of an outdoor unit is determined based on the combination of the operation stage of the outdoor unit operated before the operation signal is inputted and the operation time in the stage, and the determined operation is performed. The 1-stage thermostat can be connected to the variable-capacity outdoor unit according to circumstances.

2 Claims, 3 Drawing Sheets

UNITARY AIR CONDITIONER AND METHOD OF CONTROLLING VARIABLE OPERATION THEREOF

BACKGROUND OF THE INVENTION

1. Field of the Invention

The present invention relates to a unitary air conditioner widely used in North America, and, more particularly, to a unitary air conditioner in which a plural-stage outdoor unit is operated by means of a 1-stage thermostat. Also, the present invention relates to a method of controlling variable operation thereof.

2. Description of the Related Art

FIG. 1 is a control circuit block diagram of a conventional 1-stage unitary air conditioner showing connection of principal circuit terminals.

As shown in FIG. 1, the 1-stage unitary air conditioner is constructed such that the 1-stage unitary air conditioner receives an operation signal or a stop signal from a 1-stage thermostat 11, which is mounted in a room, for operating a 1-stage indoor unit 13 and a 1-stage outdoor unit 15.

The 1-stage unitary air conditioner with the above-stated construction is an air-conditioning system widely used as one of household appliances in North America, such as the United States of America. According to an ON/OFF operation signal from the 1-stage thermostat 11, the 1-stage indoor unit 13 and the 1-stage outdoor unit 15 are turned ON/OFF while the capacities of the 1-stage indoor unit 13 and the 1-stage outdoor unit 15 are not changed. In the 1-stage indoor unit 23 is mounted an indoor fan 17, which is rotated such that flow rate of air can be adjusted to high, middle, and low flow rates.

Recently, energy saving and more convenient heating and cooling operation have been increasingly required. To this end, a 2-stage thermostat, by which the operation of the air conditioner is controlled in a high or low operation stage, has been proposed.

FIG. 2 is a control circuit block diagram of a conventional 2-stage unitary air conditioner showing connection of principal circuit terminals.

As shown in FIG. 2, the 2-stage unitary air conditioner comprises a 2-stage thermostat 21. The 2-stage unitary air conditioner is constructed such that a 1-stage indoor unit 23 and a 1-stage outdoor unit 25 are operated in a high or low operation stage, while the capacities of the 2-stage indoor unit 23 and the 2-stage outdoor unit 25 are changed, according to a high operation signal Y2 or a low operation signal Y1 from the 2-stage thermostat 21. In the 2-stage indoor unit 23 is mounted an indoor fan 27, which is rotated such that flow rate of air can be adjusted to high, middle, and low flow rates.

However, the above-described conventional 1-stage unitary air conditioner is constructed such that the 1-stage indoor unit 13 and the 1-stage outdoor unit 15 are connected to the 1-stage thermostat 11. Consequently, it is difficult to connect the 2-stage indoor unit 13 or the 2-stage outdoor unit 15 shown in FIG. 2 to the 1-stage thermostat 11. In other words, it is difficult to connect a multiple-stage indoor unit or a multiple-stage outdoor unit to the 1-stage thermostat 11.

SUMMARY OF THE INVENTION

Therefore, the present invention has been made in view of the above problems, and it is an object of the present invention to provide a unitary air conditioner comprising a 1-stage thermostat connected to a variable-capacity outdoor unit, thereby accomplishing various applications.

It is another object of the present invention to provide a method of controlling variable operation of such a unitary air conditioner.

In accordance with one aspect of the present invention, the above and other objects can be accomplished by the provision of a unitary air conditioner comprising: a 1-stage thermostat mounted in a room for generating an air conditioner ON/OFF signal; an indoor unit configured to operate based on a signal from the 1-stage thermostat; and a variable-capacity outdoor unit connected to the 1-stage thermostat and the indoor unit, the variable-capacity outdoor unit having variable operation stages, which are changed based on the previous operation state and the current operation state.

Preferably, the variable-capacity outdoor unit is configured such that the variable-capacity outdoor unit is turned ON/OFF according to a signal from the 1-stage thermostat, and, during operation of the air conditioner, the capacity of a compressor or an outdoor heat exchanger is automatically variable by an outdoor unit control device mounted in the variable-capacity outdoor unit.

Preferably, the outdoor unit control device comprises: an operation state storage part for storing the previous or current operation state; a start operation stage determination part for determining a start operation stage, based on the previous operation stage stored in the operation state storage part, to operate the variable-capacity outdoor unit; and a stage change and determination part for determining the operation state of the variable-capacity outdoor unit according to the determination of the start operation state determination part and changing the operation stage.

Preferably, the compressor is an inverter type compressor, the capacity of which is variable, or comprises a plurality of constant-speed compressors.

In accordance with another aspect of the present invention, there is provided a method of controlling variable operation of a unitary air conditioner comprising the steps of: when a unitary-capacity operation signal is inputted from a thermostat, determining a start operation stage of an outdoor unit based on the combination of the operation stage of the outdoor unit operated before the operation signal is inputted (hereinafter, referred to as "previous operation") and the operation time in the stage; and performing the determined operation (hereinafter, referred to as "next operation").

When the outdoor unit was operated in a specific operation stage in the previous operation, and the operation time of the outdoor unit was above a predetermined period of time, the next operation is performed in the specific operation stage.

When the outdoor unit was operated in a specific operation stage in the previous operation, and the operation time of the outdoor unit was below a predetermined period of time, the next operation is performed in an operation stage lower than the specific operation stage.

When the time interval between the previous operation and the next operation is above a predetermined period of time, the next operation is performed in the highest operation stage.

Preferably, the variable operation controlling method further comprises the steps of: when the operation stage is divided into high, middle, and low operation stages, setting the high operation stage to A value, the middle operation stage to B value, which is lower than the A value, and the low operation stage to C value, which is lower than the B value, according to an operation capacity weighted value of each operation stage, and determining the next operation according to an integrated value, which is converted from the product of the weighted value of each of the successive operation stages in the previous operation and the operation time in each of the operation stages.

When $\alpha<\beta$, the next operation stage is set to the low operation state if the integrated value is less than $\alpha$, the next operation stage is set to the middle operation state if the integrated value is between $\alpha$ and $\beta$, and the next operation stage is set to the high operation state if the integrated value is greater than $\beta$.

When a specific operation stage is continued for more than a predetermined period of time after the next operation is started, the operation stage is changed to an operation stage higher than the specific operation stage.

Preferably, the variable operation controlling method further comprises the steps of: when the operation stage is divided into high, middle, and low operation stages, changing the operation stage to the high operation stage if the middle operation stage is continued for more than a first predetermined period of time; and changing the operation stage to the high operation stage if the low operation stage is continued for more than a second predetermined period of time, which is less than the first predetermined period of time.

According to the present invention, the 1-stage thermostat can be connected to the variable-capacity outdoor unit in various operation stages according to circumstances. Consequently, the present invention has the effect of accomplishing various applications and providing more pleasant air conditioned circumstances.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

It should be understood that unitary air conditioners and methods of controlling variable operation thereof according to numerous preferred embodiments of the present invention may be proposed, although only the most preferred embodiments of the present invention will be described hereinafter.

Figure 1:
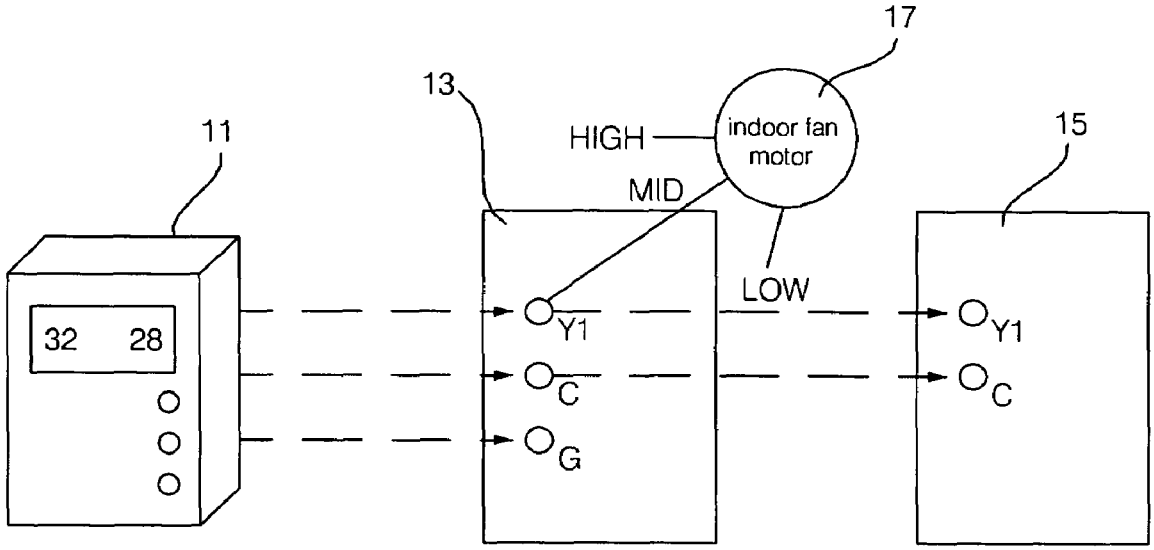
FIG. 1 (Prior Art)
FIG. 1 is a control circuit block diagram showing a conventional 1-stage unitary air conditioner.
Figure 2:
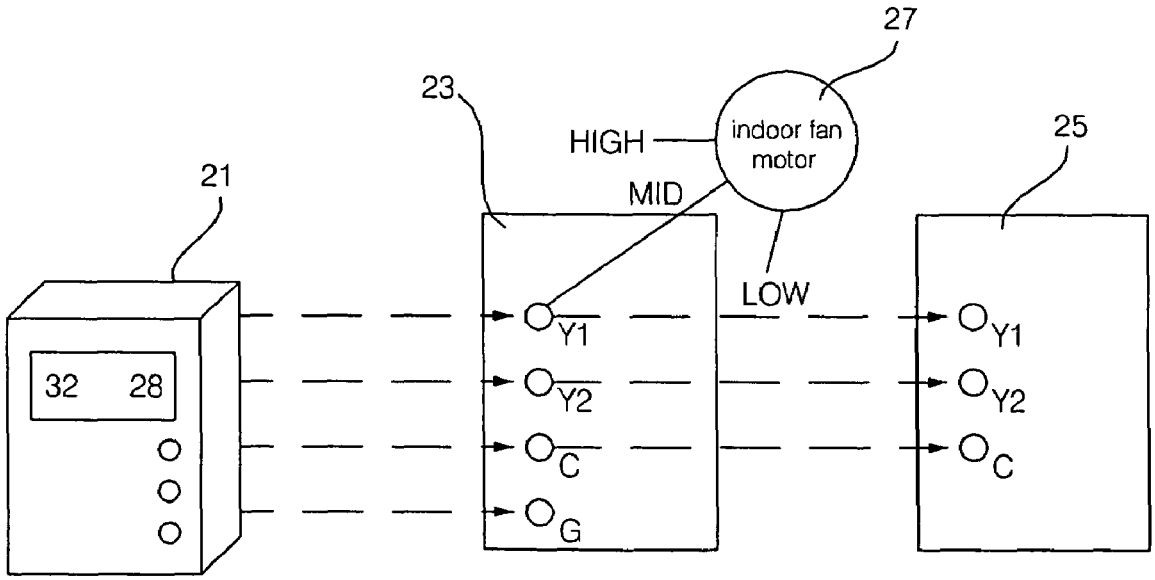
FIG. 2 (Prior Art)
FIG. 2 is a control circuit block diagram showing a conventional 2-stage unitary air conditioner.
Figure 3:
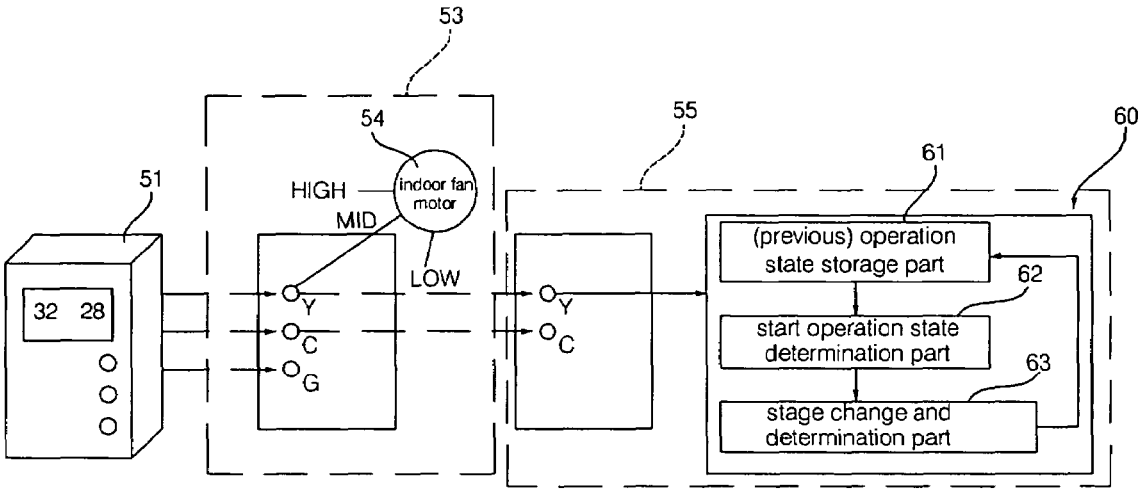
FIG. 3 is a control block diagram showing a variable-stage unitary air conditioner according to the present invention.

FIG. 3 is a control block diagram showing a variable-stage unitary air conditioner according to the present invention.

As shown in FIG. 3, the variable-stage unitary air conditioner according to the first preferred embodiment of the present invention comprises: a 1-stage thermostat 51 mounted in a room; an indoor unit 53 configured to operate based on a signal from the 1-stage thermostat 51; and a variable-capacity outdoor unit 55 connected to the 1-stage thermostat 51 and the indoor unit 53.

The 1-stage thermostat 51 is configured to generate only an ON/OFF signal, by which the air conditioned is turned on/off.

The indoor unit 53 may be configured in 1-stage fashion in which the indoor unit 53 is operated based on only a signal from the 1-stage thermostat 51. Alternatively, the indoor unit 53 may be configured in 2-stage fashion in which the indoor unit 53 is operated based on signals from the 1-stage thermostat 51 and the variable-capacity outdoor unit 55. In the indoor unit 53 is mounted an indoor fan 54, which is preferably rotated in a high, middle, or low operation stage.

The variable-capacity outdoor unit 55 is turned ON/OFF according to a signal from the 1-stage thermostat 51. The variable-capacity outdoor unit 55 is configured such that, during operation of the air conditioner, the capacity of a compressor (not shown) or an outdoor heat exchanger is automatically variable by an outdoor unit control device 60 mounted in the variable-capacity outdoor unit 55.

Specifically, the outdoor unit control device 60 comprises: an operation state storage part 61 for storing the previous or current operation state; a start operation state determination part 62 for determining a start operation stage, based on the previous operation stage stored in the operation state storage part 61, to operate the variable-capacity outdoor unit 55; and a stage change and determination part 63 for determining the operation state of the variable-capacity outdoor unit 55 according to the determination of the start operation state determination part 62 and changing the operation stage.

The compressor may be an inverter type compressor, the capacity of which is variable, or may comprise a plurality of constant-speed compressors. When the compressor comprises the plurality of constant-speed compressors, it is preferable that the capacities of the constant-speed compressors be different from one another, and therefore, the compressor is operated in three stages, for example, high, middle, and low stages.

Now, a method of controlling variable operation of the unitary air conditioner with the above-stated construction according to the present invention will be described.

Figure 4:
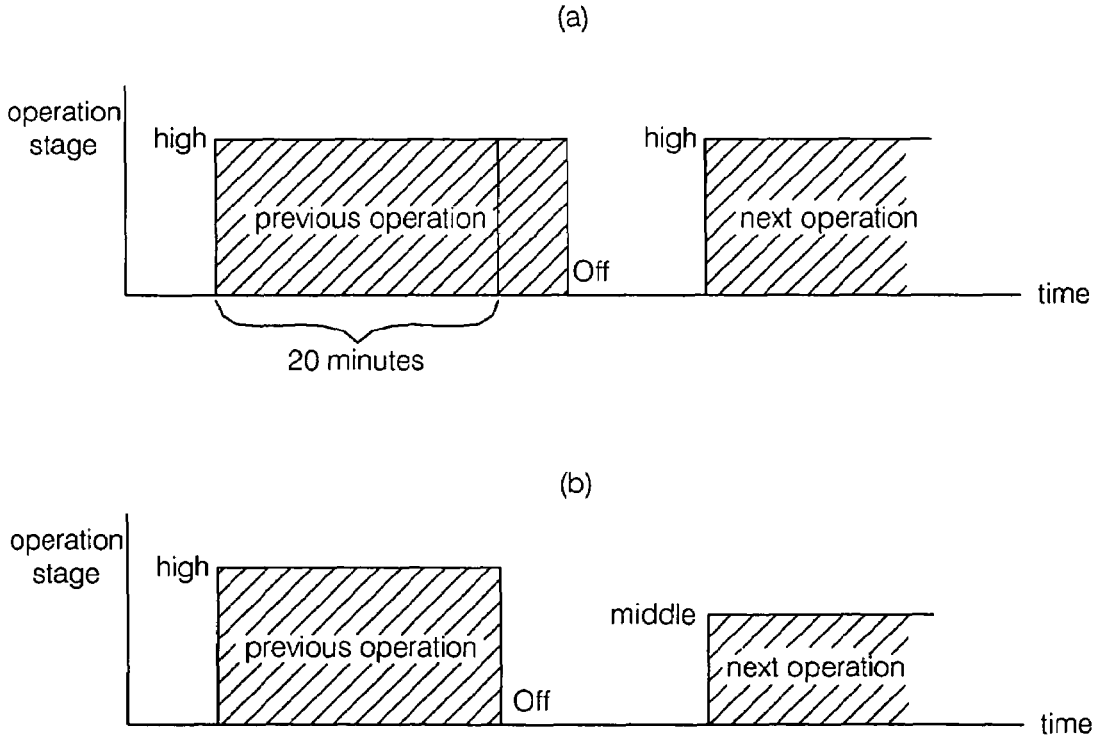
FIG. 4 is a graph illustrating change of the next operation based on the condition of the previous operation in a method of controlling variable operation of a variable-stage unitary air conditioner according to the present invention.
Figure 5:
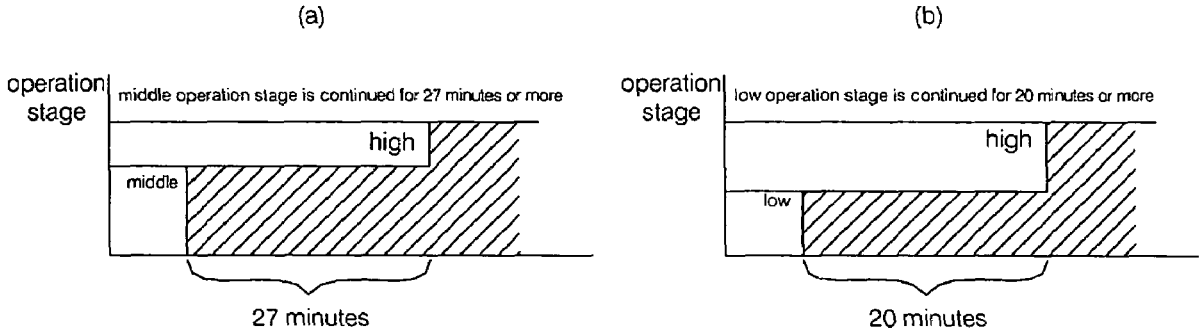
FIG. 5 is a graph illustrating change of the stage based on the operation continuance time in the method of controlling variable operation of the variable-stage unitary air conditioner according to the present invention.

FIG. 4 is a graph illustrating change of the next operation based on the condition of the previous operation in the method of controlling variable operation of the variable-stage unitary air conditioner according to the present invention, and FIG. 5 is a graph illustrating change of the stage based on the operation continuance time in the method of controlling variable operation of the variable-stage unitary air conditioner according to the present invention.

When a unitary-capacity operation signal Y is inputted to the indoor unit 53 and the variable-capacity outdoor unit 55 from the 1-stage thermostat 51, the start operation state determination part 62 of the variable-capacity outdoor unit 55 determines a start operation stage based on the combination of the operation stage of the variable-capacity outdoor unit 55 operated before the operation signal Y is inputted (hereinafter, referred to as "previous operation") and stored in the previous operation state storage part 61 and the operation time in the stage such that the variable-capacity outdoor unit 55 is operated (hereinafter, referred to as "next operation").

In the case that the previous operation was carried out in the unitary operation stage, the method of controlling variable operation of the variable-stage unitary air conditioner according to the present invention is performed as follows.

When the variable-capacity outdoor unit 55 was operated in a specific operation stage in the previous operation, and the operation time of the variable-capacity outdoor unit 55 was above a predetermined period of time, the operation state is stored in the operation state storage part 61. When the next operation is started, the variable-capacity outdoor unit 55 is operated in the specific operation stage by the start operation state determination part 62.

When the variable-capacity outdoor unit 55 was operated in the specific operation stage in the previous operation, and the operation time of the variable-capacity outdoor unit 55 was below the predetermined period of time, the variable-capacity outdoor unit 55 is operated in the operation stage lower than the specific operation stage.

When the previous operation was continuously carried out in the high operation stage for more than 20 minutes, as shown in FIG. 4(*a*), for example, it is determined that the cooling state of the cooling space requires higher cooling capacity, and therefore, the operation is started in the high operation stage even in the next operation in which the operation signal Y is inputted from the 1-stage thermostat 51.

When the previous operation was continuously carried out in the high operation stage for less than 20 minutes, as shown in FIG. 4(*b*), on the other hand, it is determined that the cooling state of the cooling space requires relatively low cooling capacity, and therefore, the operation is started in the middle operation stage in the next operation in which the operation signal Y is inputted from the 1-stage thermostat 51.

In the above description, the previous operation is operated in the high operation stage, although the middle operation stage or the low operation stage may be applied in the manner similar to the high operation stage based on the operation time.

When the time interval between the previous operation and the next operation is above a predetermined period of time (for example, 1 hour or more), the next operation is carried out in the high operation stage by the start operation state determination part 62 according to the data stored in the previous operation state storage part 61.

When the next operation is carried out approximately 1 hour after the previous operation was finished, although the previous operation was carried out in the middle operation stage for less than the predetermined period of time (for example, 20 minutes), it is determined that the operation to be carried out is the initial operation of the air conditioner, and therefore, the operation is carried out in the high operation stage.

In the case that the previous operation was successively carried out in the plural operation stages, on the other hand, the method of controlling variable operation of the variable-stage unitary air conditioner according to the present invention is performed as follows. In the following description, the variable-capacity outdoor unit 55 is operated in three operation stages, for example, high, middle, and low operation stages, which are generally used, although the variable-capacity outdoor unit 55 may be operated in various stages.

According to an operation capacity weighted value of each operation stage of the variable-capacity outdoor unit 55, the high operation stage is set to A value, the middle operation stage is set to B value, which is lower than the A value, and the low operation stage is set to C value, which is lower than the B value. The next operation is determined according to an integrated value X, which is converted from the product of the weighted value of each of the successive operation stages in the previous operation and the operation time in each of the operation stages.

According to the operation capacity weighted value, the high operation stage is set to 100, the middle operation stage is set to 55, and the low operation stage is set to 35. When the previous operation was successively carried out for a seconds ($t_3$) in the low operation stage, b seconds ($t_2$) in the middle operation stage, and c seconds ($t_1$) in the high operation stage, the integrated value X is calculated as follows:

$$X=35\times a+55\times b+100\times c$$

The next operation stage is set according to the integrated value X of the previous successive operation as calculated by the above expression. As indicated in Table 1, the next operation stage is set to the low operation stage if the integrated value X is less than α, the next operation stage is set to the middle operation stage if the integrated value X is between α and β, and the next operation stage is set to the high operation stage if the integrated value X is greater than β.

TABLE 1

| Previous operation state | | Next operation stage |
|---|---|---|
| OFF for 1 hour or more | | High |
| Less than 1 hour | $X < \alpha$ | Low |
| | $\alpha < X < \beta$ | Middle |
| | $X > \beta$ | High |

In Table 1, it is possible that α is set to 60000 and β is set to 120000.

Consequently, when the next operation is started 1 hour or more after the previous operation is completed as indicated in Table 1, the next operation is started in the high operation stage irrespective of the integrated value X of the previous operation. when the next operation is started within 1 hour after the previous operation is completed, on the other hand, the next operation is decided based on the integrated value X of each of the successive operation stages.

When the integrated value, at which the specific operation stage is continued for more than a predetermined period of time, is calculated as indicated in Table 2 after the next operation is started as described above, the current operation stage is changed to the operation stage higher than the specific operation stage.

TABLE 2

| Current operation stage | Integrated value | Changed operation stage |
|---|---|---|
| Low | $X > \alpha'$ | High |
| Middle | $X > \beta'$ | High |

In Table 2, it is possible that α' is set to 42860 and β' is set to 90000.

When the middle operation stage is continued for more than a first predetermined period of time A (for example, 27 minutes or more), as shown in FIG. 5(*a*), it is determined that increase of the indoor cooling capacity is required, and therefore, the operation stage is changed to the high operation stage and then the operation is carried out. When the low operation stage is continued for more than a second predetermined period of time B (for example, 20 minutes or more), as shown in FIG. 5(*b*), it is determined that increase of the indoor cooling capacity is required, and therefore, the operation stage is changed to the high operation stage and then the operation is carried out.

Of course, the change of the operation stage based on the continuous operation time setting may be set in various manners according to circumstances.

As apparent from the above description, the 1-stage thermostat can be connected to the variable-capacity outdoor unit in various operation stages according to circumstances. Consequently, the present invention has the effect of accomplishing various applications and providing more pleasant air conditioned circumstances.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling variable operation of a unitary air conditioner, the method comprising:

when a unitary-capacity operation signal is inputted from a thermostat, determining a start operation stage of an outdoor unit based on a previous operation defined by a weighted value of an operation stage of the outdoor unit operated before the operation signal is inputted-and the operation time in the stage, the determining comprising:

dividing the operation stage into high, middle, and low operation stages, setting the high operation stage to a value A, the middle operation stage to a value B, which is lower than the value A, and the low operation stage to a value C, which is lower than the value B, according to an operation capacity weighted value of the operation stage, the unitary air conditioner being operated in the high operation stage for a time $t_1$, in the middle operation stage for a time $t_2$, and in the low operation stage for a time $t_3$; and determining a next operation stage in accordance with an integrated value X, wherein X is defined by the equation $X=A\times t_1+B\times t_2+C\times t_3$.

2. The method as set forth in claim 1, wherein when $\alpha<\beta$, the next operation stage is set to the low operation stage if the integrated value X is less than $\alpha$, the next operation stage is set to the middle operation stage if the integrated value X is between $\alpha$ and $\beta$, and the next operation stage is set to the high operation stage if the integrated value X is greater than $\beta$.

* * * * *